US006361293B1

(12) United States Patent
Harper et al.

(10) Patent No.: US 6,361,293 B1
(45) Date of Patent: Mar. 26, 2002

(54) HORIZONTAL ROTARY AND METHOD OF ASSEMBLING SAME

(75) Inventors: Harold M. Harper, Brooklyn; Edwin L. Gannaway, Adrian, both of MI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 09/528,148

(22) Filed: Mar. 17, 2000

(51) Int. Cl.[7] ..... F04B 17/00; F04B 39/00

(52) U.S. Cl. ..... 417/363; 417/312; 417/410.3

(58) Field of Search ..... 417/363, 312, 417/410.3, 53; 181/403

(56) References Cited

U.S. PATENT DOCUMENTS

| | | | | | |
|---|---|---|---|---|---|
| 2,137,962 | A | | 11/1938 | Weiher | 230/139 |
| 2,453,297 | A | | 11/1948 | Benson | 172/36 |
| 2,454,570 | A | | 11/1948 | Rector | 230/117 |
| 2,928,589 | A | | 3/1960 | Davey | 230/232 |
| 3,187,995 | A | | 6/1965 | Kjeldsen | 230/232 |
| 3,246,836 | A | | 4/1966 | Ayling | 230/235 |
| 3,454,213 | A | * | 7/1969 | Valbjorn | 417/363 |
| 3,792,755 | A | | 2/1974 | Sanvordenker | 181/33 B |
| 4,160,625 | A | | 7/1979 | Dyhr et al. | 417/363 |
| 4,184,810 | A | | 1/1980 | Dyhr et al. | 417/363 |
| 4,242,056 | A | | 12/1980 | Dyhr et al. | 417/363 |
| 4,312,627 | A | | 1/1982 | Jacobs | 417/363 |
| 4,334,835 | A | | 6/1982 | Dyhr et al. | 417/363 |
| 4,557,677 | A | | 12/1985 | Hasegawa | 418/63 |
| 4,561,829 | A | | 12/1985 | Iwata et al. | 417/368 |
| 4,568,253 | A | | 2/1986 | Wood | 417/372 |
| 4,569,637 | A | | 2/1986 | Tuckey | 417/360 |
| 4,592,705 | A | | 6/1986 | Ueda et al. | 418/63 |
| 4,624,630 | A | | 11/1986 | Hirahara et al. | 418/63 |
| 4,626,180 | A | | 12/1986 | Tagawa et al. | 418/63 |
| 4,730,994 | A | | 3/1988 | Maertens | 417/572 |
| 4,759,698 | A | | 7/1988 | Nissen | 418/63 |
| 4,781,542 | A | | 11/1988 | Ozu et al. | 417/369 |
| 4,805,868 | A | | 2/1989 | Claude | 248/603 |
| 4,828,466 | A | | 5/1989 | Kim | 418/88 |
| 4,902,205 | A | | 2/1990 | DaCosta et al. | 417/372 |
| 4,907,414 | A | * | 3/1990 | Fraser, Jr. et al. | 417/312 |
| 4,917,581 | A | | 4/1990 | Richardson, Jr. et al. | 417/363 |
| 4,946,351 | A | | 8/1990 | Richardson, Jr. | 417/363 |
| 4,964,609 | A | | 10/1990 | Tomell | 248/638 |

(List continued on next page.)

*Primary Examiner*—Charles G. Freay
*Assistant Examiner*—Michael K. Gray
(74) *Attorney, Agent, or Firm*—Baker & Daniels

(57) ABSTRACT

A hermetic compressor includes a housing and a compressor subassembly resiliently supported within the housing. The compressor subassembly includes a motor drivingly coupled to a compressor mechanism by means of a shaft and a motor enclosure is connected to the compressor mechanism and encases the motor. A pair of grommets are disposed between the housing and the compressor subassembly whereby the compressor subassembly is resiliently suspended within the housing. The compressor mechanism discharges compressed gas into the housing through an aperture located in the motor enclosure and a quantity of oil is disposed in a lower portion of the housing. The aperture is submerged in the quantity of oil and the discharge gas exiting through the aperture is urged through the quantity of oil forming a sound damping foam. A main bearing is connected to the motor enclosure. A first discharge chamber is defined by the main bearing and the inner surface of the motor enclosure and a second discharge chamber is defined by the inner surface of the housing and an outer surface of the compressor subassembly. The first and second discharge chambers constitute a pair of mufflers to consecutively receive a quantity of discharge gas and respectively muffle the gas being respectively discharged therefrom. A method to assemble the rotary compressor includes inserting a mounting tool into a hole in the projecting portion of the motor enclosure and aligning a stator-rotor air gap prior to assembling the compressor subassembly within resilient mounts attached to the housing.

24 Claims, 7 Drawing Sheets

U.S. PATENT DOCUMENTS 4,964,786 A 10/1990 Maertens ..... 417/363
4,983,108 A 1/1991 Kawaguchi et al. ..... 418/63
5,098,266 A 3/1992 Takimoto et al. ..... 418/63
5,160,247 A 11/1992 Kandpal ..... 417/415
5,221,191 A 6/1993 Leyderman et al. ..... 417/312
5,222,885 A 6/1993 Cooksey ..... 418/96
5,226,797 A 7/1993 Da Costa ..... 418/63
5,281,106 A 1/1994 Reinhardt et al. ..... 417/354
5,499,908 A * 3/1996 Schmitz, III ..... 417/312
5,579,651 A 12/1996 Sugiyama et al. ..... 62/469
5,616,018 A 4/1997 Ma ..... 418/63
5,678,657 A 10/1997 Lee ..... 184/6.16
5,718,407 A 2/1998 Lee ..... 248/634
5,997,258 A * 12/1999 Sawyer, III et al. ..... 417/312

* cited by examiner

HORIZONTAL ROTARY AND METHOD OF ASSEMBLING SAME

BACKGROUND OF THE INVENTION

The present invention relates to hermetic compressor assemblies, and in particular, to so-called "high side" rotary compressors in which the interior of the compressor housing, including the motor chamber, is at discharge pressure.

While it is known to provide a compressor mechanism rigidly mounted within a cylindrical housing, for example, as disclosed in U.S. Pat. No. 4,639,198, assigned to the assignee of the present invention, and expressly incorporated herein by reference, such an arrangement results in an undesirable transfer of vibrational noise generated by the compressor mechanism to an appliance in which the compressor mechanism is mounted. Additionally, sound waves associated with discharge pressure pulses are readily transmitted by discharge pressure gases, the molecules of which are densely packed. These sound waves impinge upon the housing itself, generating noise which is objectionable in the space in which the compressor itself is located. Compressors heretofore, specifically high side compressors, typically discharge the noise carrying gases, relatively unattenuated, through the housing to a discharge tube attached to the housing. Generally, an external noise attenuation device, such as a muffler or the like, is attached to the discharge tube, external to the housing, to assist with decreasing fluid borne noise. The addition of a muffler or other like externally mounted attenuation device adds significant cost and an undesirable increase in required space for the compressor unit.

Therefore, it is desirable to suppress operational vibration of the compressor mechanism and to muffle fluid borne noise immediately after the compression cycle and before the gases reach the interior surface of the housing, without adding significant cost to the compressor.

SUMMARY OF THE INVENTION

The present invention overcomes the disadvantages associated with prior hermetic rotary compressors in that it provides a compressor including a housing and a compressor subassembly resiliently supported within the housing. The compressor subassembly includes a motor drivingly coupled to a compressor mechanism by means of a shaft and a motor enclosure connected to the compressor mechanism encases the motor. A pair of grommets are disposed between the housing and the compressor subassembly to resiliently suspend the compressor subassembly within the housing.

In one form of the present invention, the rotary compressor, which draws a suction gas and discharges a compressed discharge gas, includes a housing and a compressor subassembly disposed in the housing. The compressor subassembly includes a motor drivingly coupled to a compressor mechanism by means of a shaft and a motor enclosure connected to the compressor mechanism encases the motor. A quantity of oil is disposed in a lower portion of the housing wherein at least a portion of the compressed discharge gas from the compressor subassembly is directed through the quantity of oil to form a sound damping foam.

In a preferred form of the invention, a first discharge chamber is defined by a main bearing, attached to the motor enclosure, and an inner surface of the motor enclosure. A second discharge chamber is defined by an inner surface of the housing and an outer surface of the compressor subassembly. The first and second discharge chambers are in fluid communication through an aperture provided in the motor enclosure. The first and second discharge chambers constitute a pair of mufflers which consecutively receive the discharge gas.

The present invention also includes a method to assemble a rotary compressor assembly which include steps, one step being, a method of assembling a rotary compressor comprising the steps of: providing a motor enclosure attached to a stator and a rotor attached to a shaft, the shaft supported by a main bearing. Another step includes inserting a mounting tool into a hole within the motor enclosure to engage the shaft and align the stator and rotor such that a radial air gap is substantially uniform between the stator and rotor. Yet another step includes joining the main bearing to the motor enclosure, and thereafter, removing the mounting tool from the hole in the motor enclosure. The remaining steps include fastening a compressor mechanism to the main bearing which engages with and is driven by the first end of the motor shaft to form a compressor subassembly and mounting opposite axial ends of the compressor subassembly into respective resilient mounts within an interior of a housing and hermetically sealing the housing.

BRIEF DESCRIPTION OF THE DRAWINGS

The above-mentioned and other features and objects of the various forms of this invention, and the manner of attaining them, will become more apparent and the invention itself will be better understood by reference to the following description of the embodiments of the invention taken in conjunction with the accompanying drawings, wherein.

Figure 1:
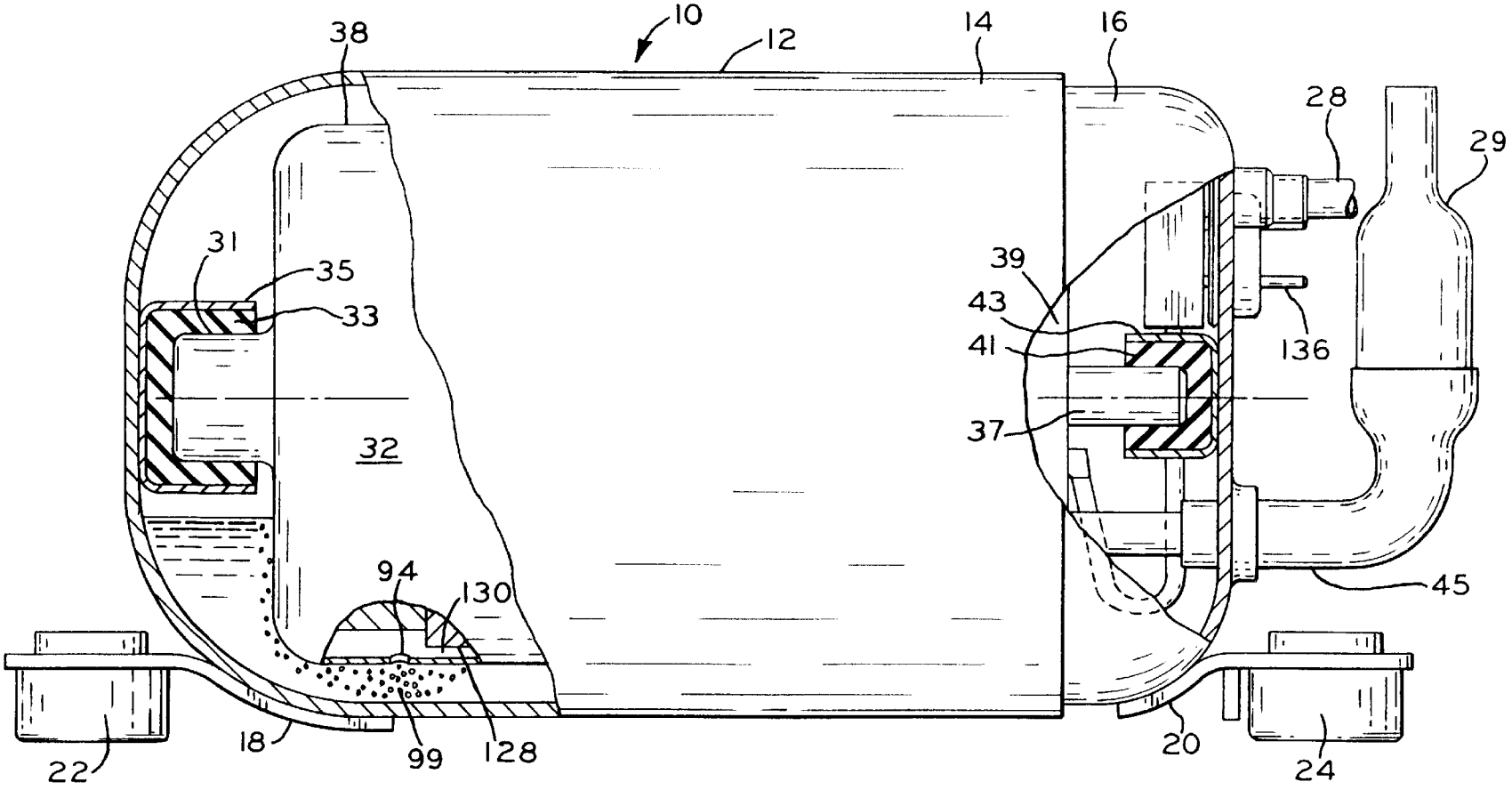
FIG. 1 is a partially sectional side view of a hermetic compressor according to one form of the present invention showing resilient mounting of the compressor subassembly and generation of a sound damping foam through oil.

Corresponding reference characters indicate corresponding parts throughout the several views. Although the drawings represent an embodiment of the present invention, the drawings are not necessarily to scale and certain features may be exaggerated in order to better illustrate and explain the present invention. The exemplification set out herein illustrates an embodiment of the invention in one form thereof, and such exemplification is not to be construed as limiting the scope of the invention in any manner.

DETAILED DESCRIPTION OF THE INVENTION

Figure 2:
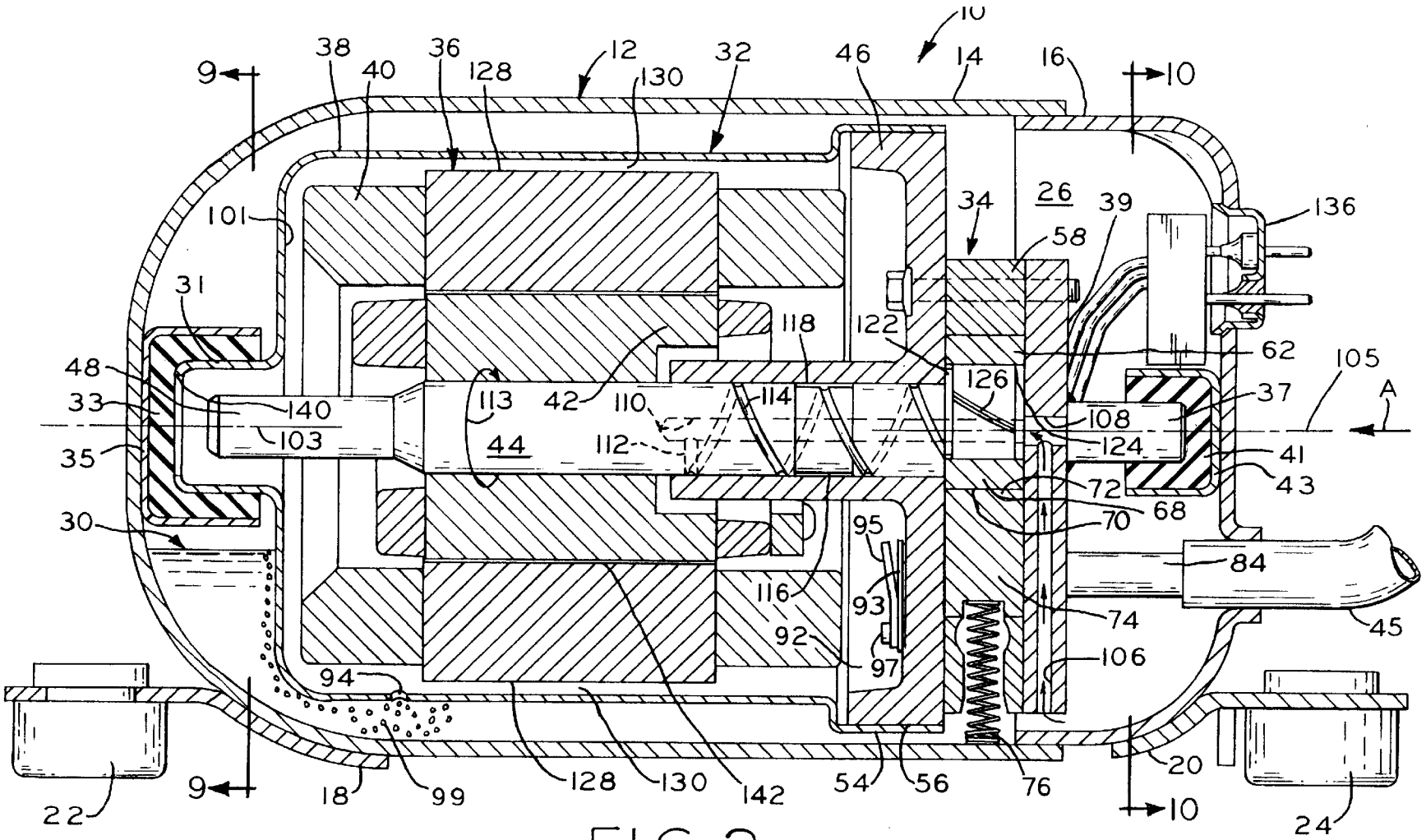
FIG. 2 is a longitudinal sectional view of the compressor of FIG. 1.
Figure 3:
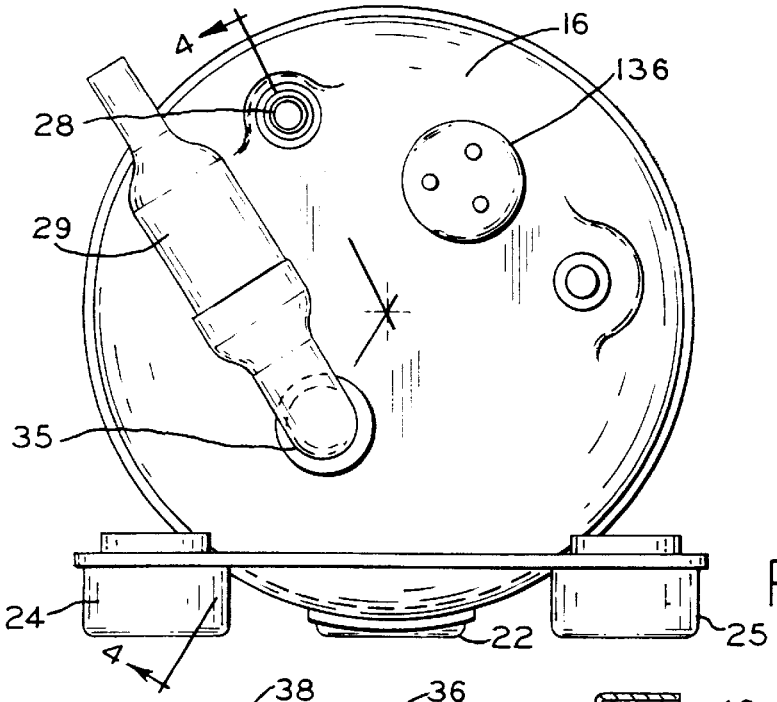
FIG. 3 is an end view of the compressor of FIG. 1.
Figure 4:
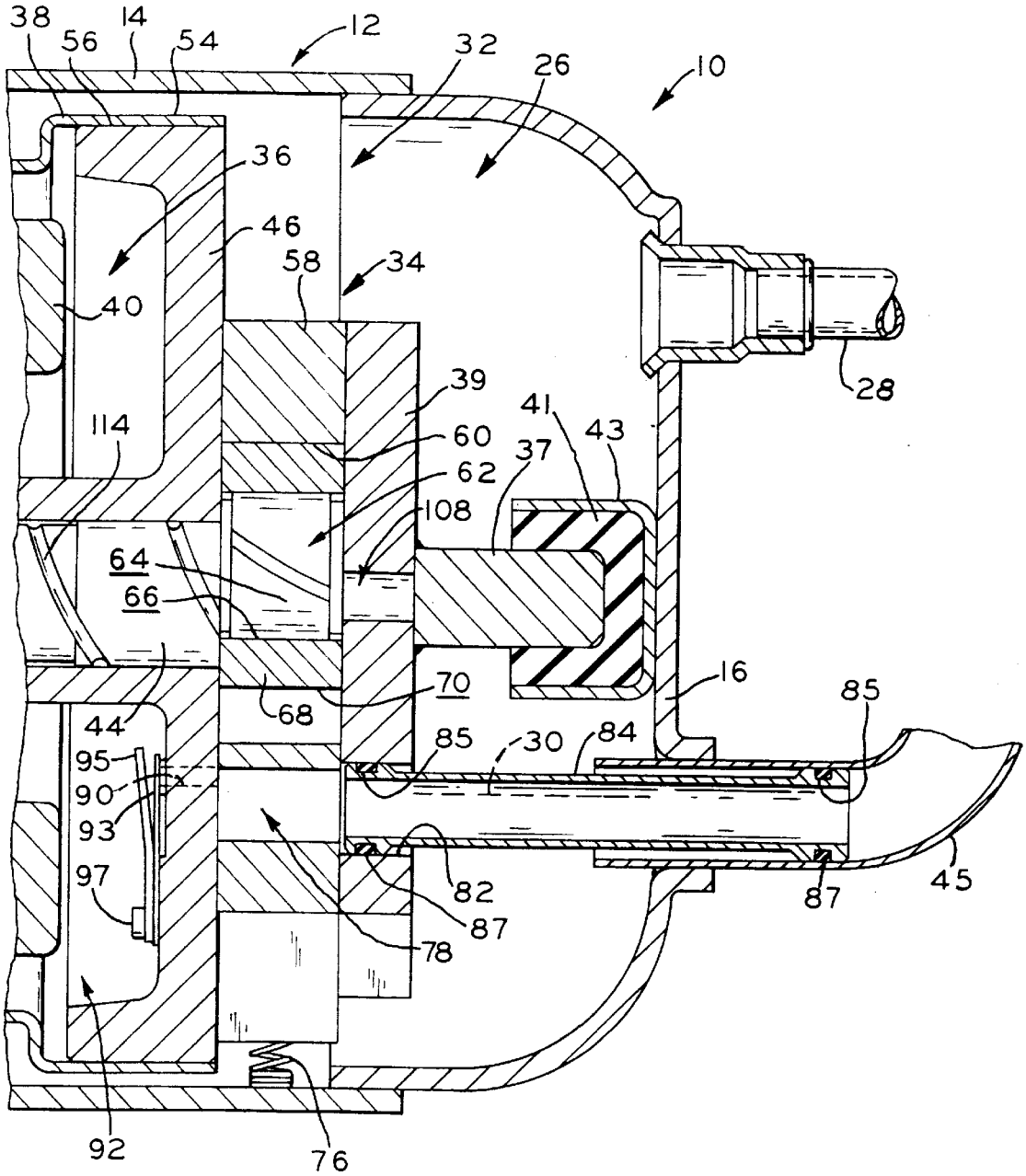
FIG. 4 is a fragmentary, enlarged sectional view of the compressor along line 4—4 of FIG. 3.

Referring to FIGS. 1, 2 and 4, rotary compressor 10 is shown as having a hermetic housing 12 comprised of first and second housing portions 14, 16, respectively, which are sealably joined together by, for example, welding or brazing. Referring to FIGS. 1–3 and 9–10, housing portions 14 and 16 are respectively provided with mounting brackets 18 and 20. Mounting bracket 18 is provided with resilient mounting foot 22 and mounting bracket 20 is provided with a pair of mounting feet 24, 25. Feet 22, 24 and 25 made of neoprene, rubber or other like vibrational damping material support compressor 10.

Referring to FIG. 1, rotary compressor 10 includes housing 12, within which compressor subassembly 32 is resiliently suspended therein. The mounting of compressor subassembly 32 includes compressor subassembly 32 being supported within housing 12 at its axially opposite ends. A first end of compressor subassembly 32, includes a projecting portion 31 of motor enclosure 38 fitting within resilient grommet 33, and in turn, grommet 33 fitting within cup 35. Cup 35 is joined to housing 12 by brazing, welding or other like joining method. The other end of compressor subassembly 32, includes post 37 extending from end plate 39 of compressor mechanism 34 (FIG. 2), fitting within resilient grommet 41, and in turn, grommet 41 is retained within cup 43. Similar to cup 35, cup 43 is attached by welding, brazing or other like joining technique to housing 12. Thus, compressor subassembly 32 is resiliently supported within housing 12 so as to provide vibrational insolation between the compressor subassembly 32 and the housing 12, to help prevent the transmission therebetween of operational vibrations generated by compressor mechanism 34 (FIG. 2).

Briefly describing the general operation of compressor 10, suction gas, typically refrigerant gas, enters suction accumulator 29, which has a filter screen therein for filtering foreign material from the refrigerant and which prevents the ingestion of liquid refrigerant by the compressor mechanism. The refrigerant gas continues into suction inlet 45, attached to housing 10, and is thereafter channeled directly into compressor mechanism 34 through end plate 39. Compressor mechanism 34 compresses the refrigerant gas and the compressed refrigerant gas is expelled into a chamber defined by the interior of the motor enclosure 38 and main bearing 46. Finally, the compressed refrigerant gas is further discharged from motor enclosure 38 into an interior portion of housing 12, and exits housing 12 through discharge tube 28. Hermetic compressor 10 may be part of a refrigeration system comprising heat exchangers and interconnecting conduits through which the heat exchangers, a flow restriction device, and the inventive compressor are fluidly interconnected.

Referring to FIG. 2, motor 36 is disposed within bell or cup-shaped motor enclosure 38 and includes stator 40, attached to motor enclosure 38, and rotor 42 which is rotatably disposed within stator 40. Shaft 44 is attached to rotor 42 and the rotor and shaft are supported by main bearing 46. The motor, comprising stator 40 and rotor 42, in addition to a portion of shaft 44 and a lateral surface of main bearing 46, are encased within motor enclosure 38 forming a portion of self-contained compressor subassembly 32 as described further below. Shaft 44 includes free end 48 which is unsupported and extends into projecting portion 31 of motor enclosure 38. Projecting portion 31 and motor enclosure 38 may be made from carbon steel sheet stock and respectively formed by, for example, a deep drawing process, such that projecting portion 31 is integral with motor enclosure. Bell end or open end 54 of motor enclosure 38 is disposed about outer periphery 56 of main bearing 46 and may be attached to main bearing 46 by, for example, a shrink fit.

Figure 5:
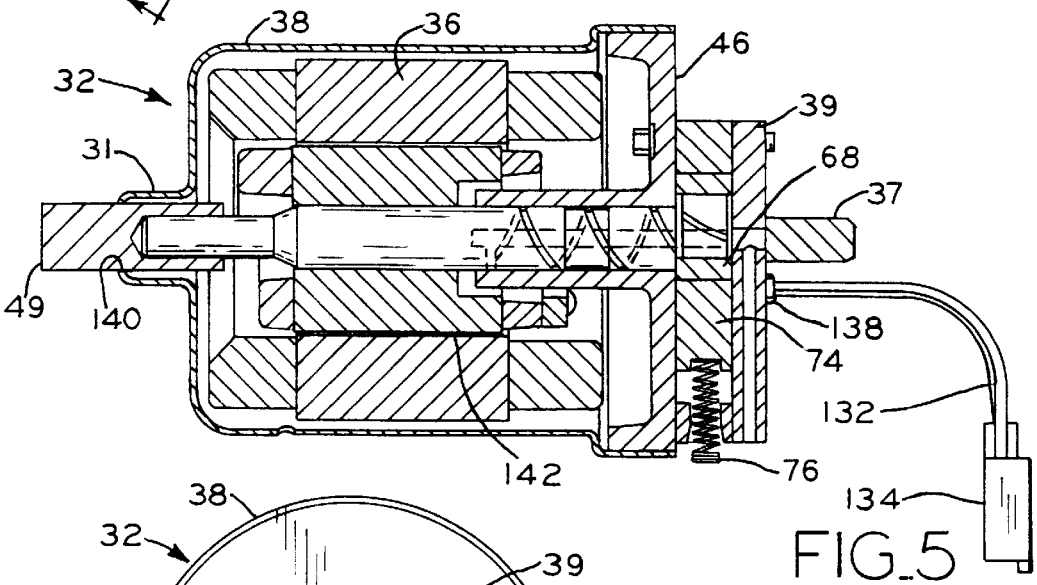
FIG. 5 is a longitudinal sectional view of the compressor subassembly showing the assembly tool extending from an axial end of the subassembly.

Referring to FIG. 4, compressor mechanism 34 comprises cylinder block 58 sandwiched between main bearing 46 and end plate 39. Cylinder block 58 includes cylindrical cavity 60 in which is disposed eccentric portion 62 of shaft 44. Eccentric portion 62 has cylindrical surface 64 which slidably engages inner cylindrical surface 66 of piston or roller 68. Outer circumferential surface 70 of roller 68 engages the surface of cylindrical cavity 60 as it rolls about cylindrical cavity 60. Tip 72 of vane 74 is urged into engagement with outer circumferential surface 70 of roller 68 under the influence of spring 76 (FIG. 2). As best shown in FIGS. 2 and 5, a nylon insert or Teflon button (not shown) may be inserted between spring 76 and housing 12 to prevent binding of spring 76 if slight variation or movement of compressor subassembly 32 with respect to the housing occurs. Referring now to FIG. 4, suction pressure region 78 is defined on one lateral side of vane 74 within cylindrical cavity 60. End plate 39 is disposed adjacent cylinder block 58 on the side opposite main bearing 46, and is provided with suction port 82 which extends into suction pressure region 78. Suction conduit 84 includes a first end extending into suction port 82 of end plate 39 and a second end extending into suction tube 45. Each end of suction conduit 84 has circumferential groove 85 which receive O-rings 87. O-rings 87 respectively contact suction tube 45 and suction port 82 to provide a pair of sealed joints while allowing mobility of suction conduit 84. Notably, suction conduit 84 is moveable, i.e. it may rotate, experience endwise movement or pivot respective of either end, without sacrificing the respective suction inlet seals formed by O-rings 87. Refrigerant gas, substantially at suction pressure, is drawn into suction pressure region 78 through suction conduit 84 (FIG. 2).

Figure 6:
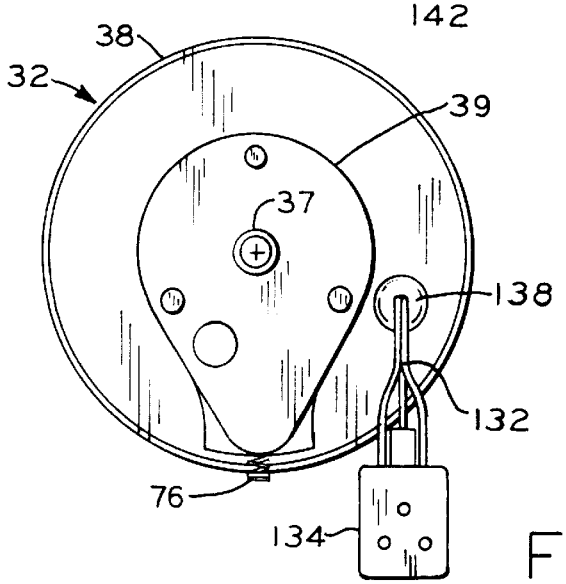
FIG. 6 is an end view of the compressor subassembly of FIG. 5.
Figure 11:
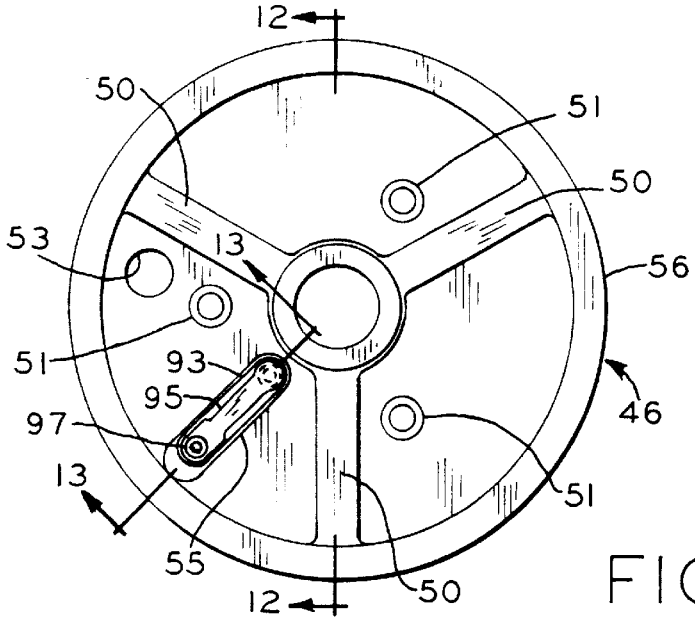
FIG. 11 is a transverse view of the main bearing viewed from within the motor enclosure.
Figure 12:
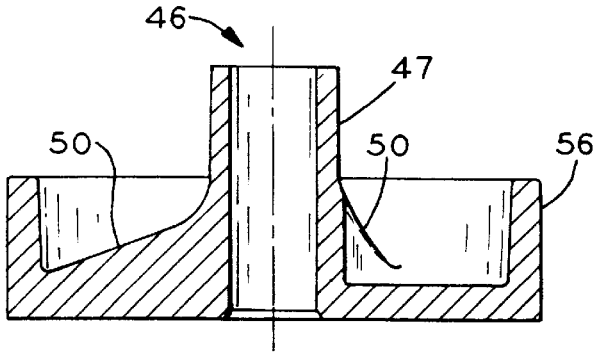
FIG. 12 is a sectional view of the main bearing along line 12—12 of FIG. 11.
Figure 13:
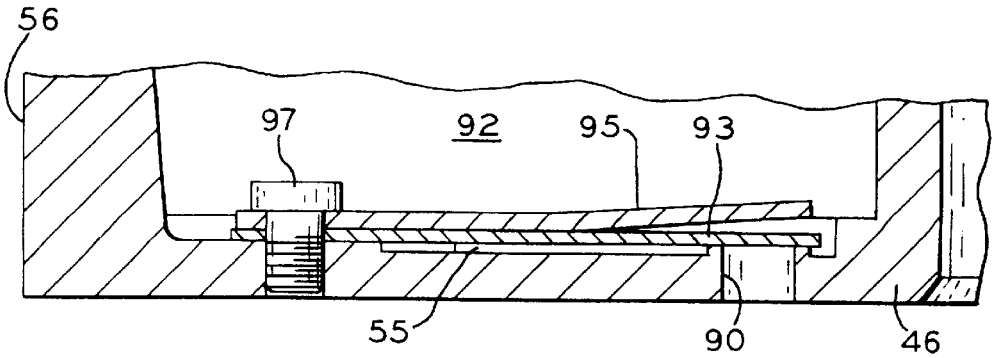
FIG. 13 is an enlarged sectional view of a discharge check valve assembly along line 13—13 of FIG. 11.

Referring to FIGS. 11 and 12, main bearing 46 includes three like and equidistantly positioned web portions 50 and outer periphery 56. Main bearing 46 also includes three like threaded holes 51 to receive respective fasteners to secure cylinder block 56 between end plate 39 and main bearing 46. Main bearing 46 includes an additional hole 53 to allow electrical leads 132 to pass through main bearing 46 to provide electrical current to the stator winding of motor 36 (FIGS. 5 and 6). Discharge valve 93 is mounted in recessed portion 55 of main bearing 46 (FIGS. 11 and 13). Referring to FIG. 13, discharge valve 93 and retainer 95 overlay discharge passageway 90, generally constituting a through hole having a diameter, for example, of between 0.158–0.162 inches. Discharge valve 93 and retainer 95 are respectively secured to main bearing 46 by screw 97. Discharge valve 93 prevents a back flow of refrigerant gas in enclosure 38 from re-entering cylindrical cavity 60 through passageway 90. Passageway 90

Referring to FIGS. 2 and 4, on an opposite lateral side of vane 74 from suction pressure region 78, is a discharge pressure region from which refrigerant compressed within compression mechanism 34 is discharged through main bearing 46 and into first discharge chamber 92 through passageway 90. First discharge chamber 92 is defined by a surface of main bearing 46 and an inner surface of motor enclosure 38. Referring to FIG. 12, main bearing 46 includes collar portion 47 having sufficient length to support shaft 44 at a mid portion, thus, each end of shaft 44 need not be supported.

As best shown in FIG. 2, compressed refrigerant gas flows through passageway 90, enters first discharge chamber 92 and thereafter flows into second discharge chamber 26 through aperture 94. Aperture 94, constituting, for example, a through hole of 0.183–0.193 inches, is provided in motor enclosure 38 at an axial end thereof, and positioned between stator 40 and axial wall 101 of motor enclosure 38. Discharge gas, expanding into first discharge chamber 92, decreases in energy and provides sound attenuation or muffling of the discharge gas. Similarly, the consecutive expansion of discharge gas conveyed from first discharge chamber 92 to second discharge chamber 26 through aperture 94 provides additional attenuation or muffling of the discharge gas. Therefore, first and second discharge chambers 92, 26 respectively define a pair of mufflers which consecutively receive discharge gas therein.

To avoid an undesirable backpressure of discharge gas within first discharge chamber 92, aperture 94 within motor enclosure 38 includes a cross-sectional area or flow area substantially similar to a flow area provided by passageway 90 to facilitate a suitable exit for the discharge gas from compressor subassembly 32. It is envisioned that, rather than a single aperture 94 providing a flow area similar to that of the flow area associated with passageway 90, a plurality of apertures manifesting an aggregate flow area similar to that of the flow area associated with passageway 90 would alternatively provide a suitable exit for the discharge gas.

Figure 7:
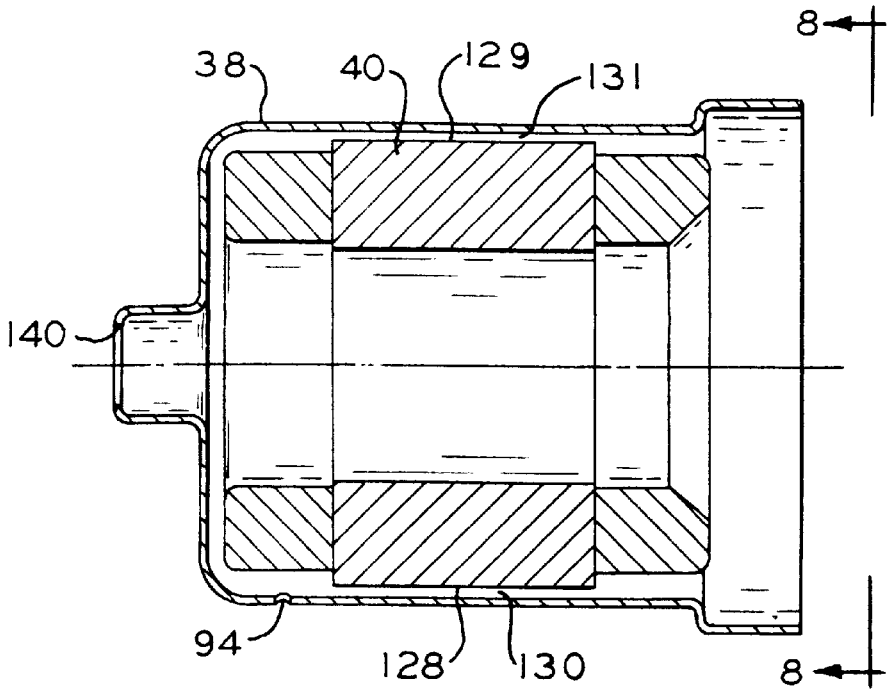
FIG. 7 is a longitudinal sectional view of the motor enclosure and stator of FIG. 5.
Figure 8:
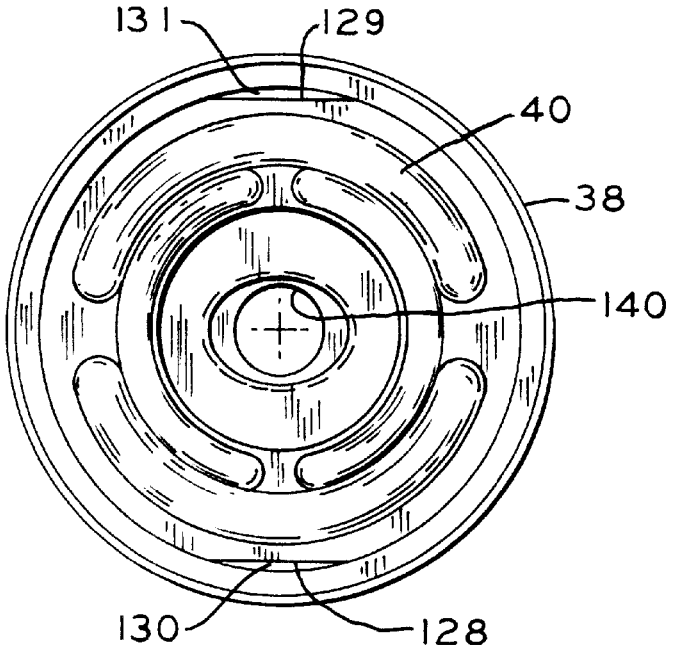
FIG. 8 is an end view of the motor enclosure and stator along line 8—8 of FIG. 7.

Referring to FIGS. 2 and 4, detailing the purging of oil from the motor compartment of compressor subassembly 32, discharge gas exiting the discharge pressure region (not shown) within compression mechanism 34 through passageway 90 (shown also in FIG. 13) serves to flush oil from first discharge chamber 92. Referring now to FIGS. 7 and 8, stator 40 is interference fitted into motor enclosure 38, and is provided with, positioned radially opposite, pair of flats 128 and 129 which define channels 130 and 131, respectively, between the outer peripheral surface of the stator and the interior surface of motor enclosure 38. Channel 130 is located axially between main bearing 46 and aperture 94 and is positioned adjacent aperture 94 (FIG. 2). Referring to FIG. 2, discharge gas within first discharge chamber 92 flows through channel 130, due to a lower pressure condition existing proximate to aperture 94 respective of a higher pressure condition existing proximate to passageway 90 of main bearing 46. The difference in pressures forces oil, accumulated in a lower portion of motor enclosure 38, to purge through channel 130, directed from main bearing 46 to aperture 94, and exit aperture 94. Thus, first discharge chamber 92 may be effectively purged of oil to prevent the undesirable effect of oil entering air gap 142 between stator 40 and rotor 42.

Thus, refrigerant gas at discharge pressure, is received into first discharge chamber 92 from the discharge pressure region within the compression mechanism 34 through passage 90 and the gas is discharged from first discharge chamber 92 into second discharge chamber 26 through aperture 94. Notably, aperture 94 is located below oil surface level 30 and as discharge gas is discharged through aperture 94, it foams the oil about aperture 94 outside of enclosure 38. The foaming action of the discharge gas being forced through the oil creates a sound damping foam 99 (FIGS. 1 and 2). Generally, the noise associated with discharge gas is caused by pressure pulses created by the cyclic compression of gases within the compression mechanism. This noise, having a relatively increased energy level associated therewith, exits the compression mechanism and travels through first and second discharge chambers 92, 26, respectively. Cells of the foam 99, created by the discharge gas being urged through aperture 94, dampen the noise by providing an acoustical layer, which acts to absorb a portion of the relatively energized discharge gas exiting the compressor mechanism. Generally, the acoustical layer, formed by the cells of foam, dampen noise by segregating and diverting a unitary jet of discharge gas, into smaller less energized jets, resulting in an attenuation of noise. The discharge gas bubbles out of foam 99 and enters the upper portion of second discharge chamber 26, thereafter exiting housing 12 through discharge tube 28 (FIGS. 1 and 2). Therefore, the sound damping action of the foam constitutes a form of sound attenuation or muffling which is intermediately positioned respective of, and in addition to, the pair of mufflers defined by first and second discharge chambers 92 and 26 respectively.

As mentioned above, the undesirable effect of significant backpressure of discharge gas within first discharge chamber 92 may be avoided by alternatively providing a plurality of apertures within motor enclosure 38, in lieu of aperture 94, however preserving the flow area of that of passageway 90. The plurality of apertures, as an alternative to a single aperture, may include grouping the plurality of apertures closely together and, similar to the placement of single aperture 94, placing the plurality of apertures, respective of motor enclosure 38, below oil surface level 30 to ensure that proper noise damping foam is formed. Yet another alternative includes providing a portion of the plurality of apertures beneath oil level 30, to provide suitable noise attenuating foam formation, and additionally, providing apertures above the oil level to prevent undesirable backpressure formation within first discharge chamber 92.

Figure 9:
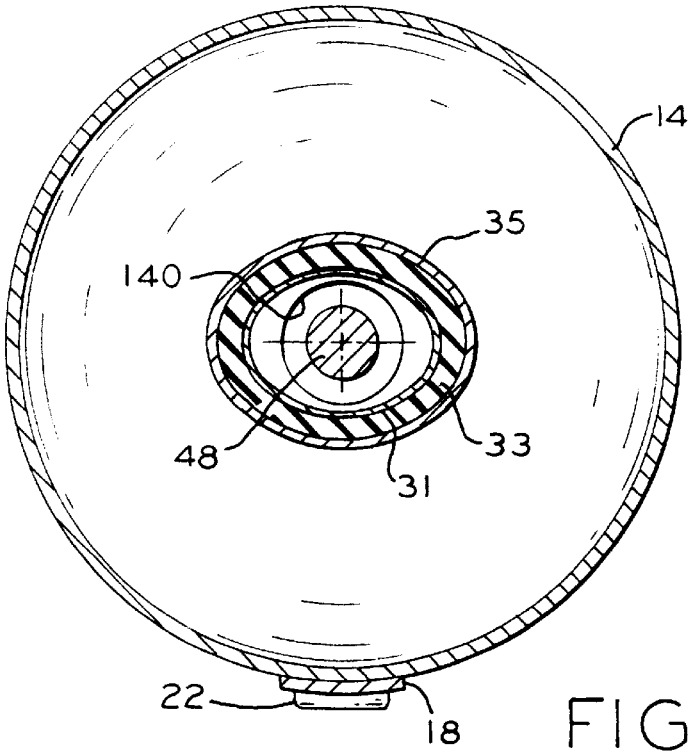
FIG. 9 is a sectional view of a resilient mount assembly along line 9—9 of FIG. 2.

As best shown in FIG. 2, axis of rotation 105 of shaft 44 is substantially horizontal, and is substantially concentric with the axis of projection portion 31 of motor enclosure 38. Also coaxial with the axis of rotation of the shaft, is cylindrical post 37 which is rigidly attached to and extending from end plate 39. Post 37 is attached to end plate 39 by welding, threaded fasteners or other suitable fastening means. As mentioned above and shown in FIGS. 1 and 2, projecting portion 31 of motor enclosure 38 and post 37 are respectively supported within cup-shaped grommets 33 and 41, respectively. Grommets 33, 41, respectively, may be composed of a vibration absorbing material such as, for example, neoprene, rubber or any other like resilient material which supports compressor subassembly 32 within second discharge chamber 26. Grommets 33 and 41, respectively, are mounted in cup-shaped mounting members 35, 43, respectively, which are attached to the interior surfaces of housing portions 14 and 16, respectively. Cups 35, 43 may be made of carbon steel, being similar in composition to housing 12, so cups 35, 43, respectively may be welded, spot welded or fastened in a like manner to housing 12. The resilient mounting of the compressor subassembly within housing 12 also helps to isolate vibrations and other noises associated with compressor mechanism operation. Referring to FIG. 2, projecting portion 31 of motor enclosure 38 snugly fits within resilient grommet 33. Further, substantially all of an outer surface of at least one of the extending portions is surrounded by the respective grommet to enhance support and prevent excessive movement of the compressor subassembly. Grommet 33 can best be described as being cup-shaped, however respective outer and inner surfaces of grommet 33 are substantially elliptical in transverse cross sectional shape. Referring to FIG. 9, better showing the elliptical shape of cup 35 and grommet 33, cup 35 is fastened to housing 14 by welding or the like such that central axis 103 (FIG. 2) of the ellipse is substantially coaxial with axis of rotation 105 of shaft 44. Grommet 33 may be attached to cup 35 by the use of adhesive or other like bonding means. Alternatively it may be merely closely fitted thereinto. Grommets 33 and 41 mate with respective extending portions 31 and 37 to decrease transfer of vibrational noise generated by compressor mechanism 34. Additionally, grommets 33 and 41 limit endwise movement and pivotal movement about shaft axis of rotation 105 (FIG. 2). Further, extending portion 31 and grommet 33, due to their respective non-circular cross sections, prevent rotation of compressor subassembly 32 respective of housing 12.

Projecting portion 31 of motor enclosure 38 includes hole 140, exposing free end 48 of shaft 44, to facilitate positioning free end of shaft 44 during installation and assembly of shaft 44, motor 36, main bearing 46 and motor enclosure 38 to set air gap 142 between rotor 42 and stator 44 (FIG. 2). Hole 140, within projection portion 31, is substantially concentric with shaft 44 such that a mounting assembly tool may be inserted into hole 140 of projecting portion 31 to position shaft 44. As mentioned above, projecting portion 31 of motor enclosure 38 snugly fits within grommet 33, thus hole 140 is sealed within projecting portion 31 so that an insignificant amount of discharge gas within motor enclosure 38 (not shown) may escape enclosure 38 other than through aperture 94.

Figure 10:
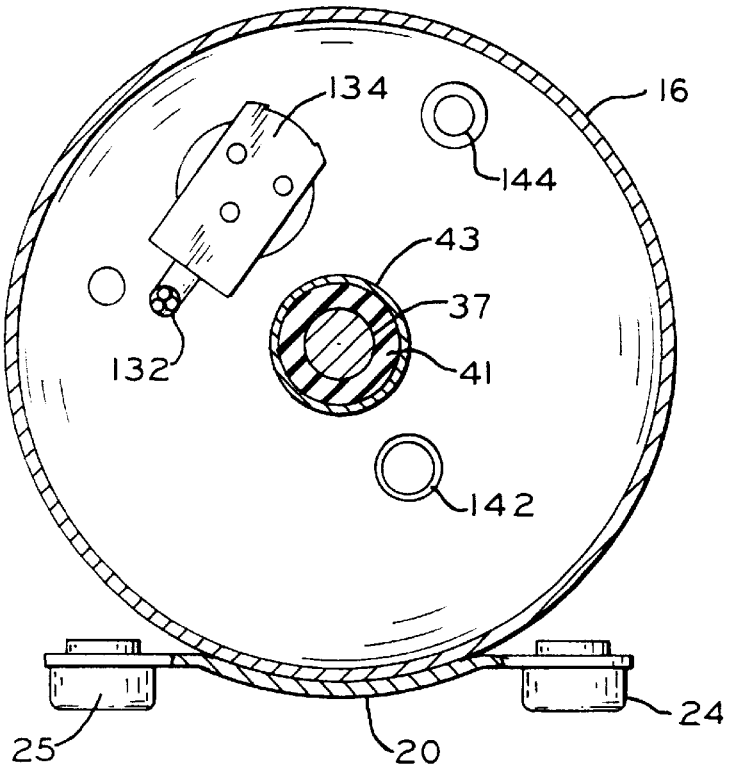
FIG. 10 is a sectional view of a resilient mount assembly along line 10—10 of FIG. 2.

The opposing resilient mount supporting post 37 is best shown in FIG. 10. Post 37 is substantially circular in cross-section and snugly fits within annular, cup-shaped grommet 41. Grommet 41, similar to grommet 33, comprises a resilient material, such as neoprene or rubber and grommet 33 is also cup-shaped. However, grommet 41 is substantially in cross-section and snugly fits within cup 43. As mentioned above, cup 43 attaches to housing portion 16 by means of welding, brazing or other like method of attachment. Also shown in FIG. 10 are suction and discharge ports 142, 144, respectively, as well as connector 134 and electrical leads 132 connected thereto.

Referring to FIGS. 5 and 6, compressor subassembly 32 comprises a self-contained compressor unit having motor 36 fitted within motor enclosure 38. Electrical leads 132 extend from compressor subassembly 32 and include connector 134 which connects with terminal 136 (FIGS. 1 and 2). Electrical leads 132 pass through end plate 39, sealed by insulator plug 138, and electrically connect the stator independent of the motor 36. An insignificant amount of discharge gas, in motor enclosure 38, may leak past electrical leads 132 and insulator plug 138 during operation. As customary in the art, electrical leads 132 are resistant to refrigerant and lubricating oil.

Referring to FIG. 2, showing the lubrication means of hermetic compressor 10, end plate 39 is provided with passageway 106 which has an inlet located below surface level 30 of the oil in second discharge chamber 26. Oil travels upwards through passageway 106 under the influence of fluid, substantially at discharge pressure acting on the oil, to chamber 108 formed in the end plate, the shaft axis of rotation extending through chamber 108. Chamber 108 is in fluid communication with bore 110 which extends from one terminal end of shaft 44 at the surface of eccentric portion 62 to a location along shaft 44 which is leftward of the end of main bearing 46 as viewed in FIG. 2. Bore 110 is coaxial with the shaft axis of rotation. Near the end of bore 110, shaft 44 is provided with radial passage 112 which is in fluid communication with bore 110 and the interior journal portion of main bearing 46. Notably, bore 110 is substantially at discharge fluid pressure. The rotation of shaft 44 clockwise as viewed in the direction of arrow A, in the direction indicated by arrow 113, centrifugally raises the pressure of the oil in passageway 112 to a pressure which is somewhat higher than discharge pressure. Radial passage 112 is in fluid communication with the beginning of helical groove 114 which is formed in the outer cylindrical surfaces of shaft 94 which is journalled within main bearing 46. Helical groove 114 is somewhat shallow, and as shaft 44 rotates in the direction of arrow 113, the oil received from bore 110 through passageway 112 and into helical groove 114 is pumped rightward as viewed in FIG. 2 through the helical groove. The oil within the groove is in contact with the interior, journalling surface of main bearing 46, thereby providing lubrication of the journal portion of the shaft.

Helical groove 114 is open into an undercut portion 116 of shaft 44 which defines annular chamber 118 in the shaft at a location approximately left of center of its journalled portion within main bearing 46. Oil within annular chamber 118 also helps to provide lubrication of the shaft and bearing interface, and provide some hydrodynamic support of the shaft within the bearing. Chamber 118 is primarily used to reduce the surface contact between the shaft and bearing to reduce friction therebetween. Oil within annular chamber 118 is also in fluid communication with a portion of helical groove 114 which is rightward thereof, as viewed in FIG. 2, and the oil continues to be pumped through the helical groove to the end of the journalled, concentric portion of shaft 44 which is coaxial with the shaft axis of rotation. Those skilled in the art will recognize that the configuration of the shaft, bearing, and helical groove provided in the shaft, the helical groove provided with a source of oil at one end thereof, during rotation of the shaft in the direction of arrow 113, comprises an oil pump. Rotation of shaft 44 in direction of arrow 113 delivers oil to first eccentric annular chamber 122 which is defined between eccentric portion 62 and the inner cylindrical surface of roller 68, between main bearing 46 and the edge of cylindrical surface 64 in the eccentric portion. Oil pumped into first eccentric annular chamber 122 is leaked radially outward through the interface between main bearing 46 and roller 68, thereby lubricating that interface, as well as providing a portion of high pressure oil to the interior of compression mechanism 34. Hence, lubricating oil will be provided to the interface between vane tip 72 and the outer circumferential surface 70 of roller 68.

Second eccentric annular chamber 124 is disposed between end plate 39 and the edge of cylindrical surface 64 of eccentric portion 62. Groove 126 is provided in the cylindrical surface 64 of eccentric portion 62. Groove 126 may be helical and, in a manner similar to that described above, will pump oil from first eccentric annular chamber 122 to second eccentric annular chamber 124. The high pressure oil delivered to second eccentric annular chamber 124 may leak past the interface between the annular end of roller 68 and end plate 39, thereby providing additional oil to cylindrical cavity 60 and the interior of compression mechanism 34. A portion of the oil, which is at a pressure higher than discharge pressure, may also enter bore 110 near its connection to chamber 108. Thus a small quantity of oil may also be delivered to the exterior of shaft 44 located within main bearing 46 through bore 110 and radial passage 112.

Rotary compressor 10 may be assembled such that the radial air gap 142 (FIG. 5) between the stator and rotor is substantially uniform. In order to provide a proper air gap between stator 40 and rotor 42, a process of assembling a rotary compressor according to the present invention includes the steps of: providing a motor enclosure 38 including a projecting portion 31 extended from an axial end and the other axial end of the motor enclosure 38 having an open end 54, a hole 140 is axially positioned and extends through the projecting portion 31; assembling a motor enclosure 38 and a stator 40; attaching a rotor 42 to a motor shaft 44 to form a rotor assembly and inserting a first end 51 of shaft 44 into a main bearing 46; assembling the rotor assembly and main bearing 46 with the motor enclosure 38 such that the main bearing 46 fits within the open end 54 of the motor enclosure 38 and a second end 48 of the motor shaft 44 extends within an interior of the projecting portion; inserting a mounting tool 49 into the hole 140 of the projecting portion 31 to engage the second end 48 of the motor shaft (FIG. 5); aligning the rotor 42 with the stator 40 by selectively positioning the mounting tool 49 to establish a substantially uniform radial rotor-stator air gap 142 positioned between the stator 40 and rotor 42; joining the main bearing 46 to the motor enclosure 38; removing the mounting tool 49 from the hole 140 in the projecting portion 31 of the motor enclosure 38; fastening a compressor mechanism 34 (FIGS. 2 and 4) to an outer surface of the main bearing 46 which engages with and is driven by the first end 57 of the motor shaft 44 to form a compressor subassembly 32; and mounting opposite axial ends 31, 37 of the compressor subassembly 32 into respective resilient mounts 33, 41 within an interior of a housing 12 and joining the two housing portions 14, 16 (FIGS. 1 and 2) by, for example, welding to form a hermetically sealed compressor assembly 10. Further, prior to assembling the compressor subassembly 32 with housing 12, spring 76 is provided between vane 74 and an interior surface of housing 12 to urge vane 74 against outer surface 70 of roller 68 within cylindrical cavity (FIGS. 2 and 4).

While this invention has been described as having an exemplary embodiment, the present invention can be further modified within the spirit and scope of this disclosure. This application is therefore intended to cover any variations, uses, or adaptations of the invention using its general principles.

What is claimed is:

1. A rotary compressor comprising:

a housing;

a compressor subassembly disposed in said housing and comprising a motor drivingly coupled to a compressor mechanism by means of a shaft, and a motor enclosure connected to said compressor mechanism and encasing said motor, a refrigerant-containing chamber located between said housing and said motor enclosure; and a pair of grommets disposed between said housing and said compressor subassembly whereby said compressor subassembly is resiliently suspended within said housing.

2. The rotary compressor of claim 1, wherein said compressor subassembly includes a pair of axial ends extending outwardly and opposite to each other, said axial ends are supportively disposed within said pair of grommets.

3. The rotary compressor of claim 2, wherein at least one of said grommets surrounds substantially all of an outer surface of one of said pair of axial ends.

4. The rotary compressor of claim 2, wherein one of said axial ends constitutes a projecting portion and the other of said axial ends constitutes a post, said post is fixedly attached to said compressor mechanism and said projecting portion is attached to said motor enclosure.

5. The rotary compressor of claim 2, wherein at least one of said axial ends includes a non-circular cross-section whereby radial movement of said compressor subassembly is prevented.

6. The rotary compressor of claim 5, wherein one of said pair of grommets contacting said non-circular axial end includes a non-circular transverse cross section.

7. The rotary compressor of claim 6, wherein said non-circular transverse cross-section of said non-circular axial ends is elliptical.

8. The rotary compressor of claim 1, further including a suction conduit fluidly connecting said compressor subassembly with said housing, said suction conduit sealably attached to said compressor subassembly through a suction port and to said housing through a suction inlet, said suction conduit moveable relative to at least one of said suction inlet and said suction port, whereby said compressor subassembly is moveable respective of said housing.

9. A rotary compressor comprising:

a housing;

a compressor subassembly disposed in said housing and comprising a motor drivingly coupled to a compressor mechanism by means of a shaft and a motor enclosure connected to said compressor mechanism and encasing said motor, said compressor subassembly including a pair of axial ends extending outwardly and opposite to each other; and a pair of grommets disposed between said housing and said compressor subassembly whereby said compressor subassembly is resiliently suspended within said housing, said compressor subassembly axial ends being supportively disposed within said pair of grommets;

wherein one of said pair of axial ends includes a hole disposed therein, whereby an end of said shaft is exposed for inspecting the alignment of a motor rotor attached thereto relative to a motor stator, said hole sealed by one of said pair of grommets.

10. A rotary compressor comprising:

a housing;

a compressor subassembly disposed in said housing and comprising a motor drivingly coupled to a compressor mechanism by means of a shaft and a motor enclosure connected to said compressor mechanism and encasing said motor; and a pair of grommets disposed between said housing and said compressor subassembly whereby said compressor subassembly is resiliently suspended within said housing;

wherein the compressor includes said compressor subassembly having a main bearing attached to said motor enclosure and a first discharge chamber defined by said main bearing and an inner surface of said motor enclosure, a second discharge chamber defined by an inner surface of said housing and an outer surface of said compressor subassembly, said first and second discharge chambers in fluid communication through an aperture provided in said motor enclosure.

11. A rotary compressor comprising:

a housing;

a compressor subassembly disposed in said housing and comprising a motor drivingly coupled to a compressor mechanism by means of a shaft and a motor enclosure connected to said compressor mechanism and encasing said motor; and a pair of grommets disposed between said housing and said compressor subassembly whereby said compressor subassembly is resiliently suspended within said housing;

wherein said compressor subassembly includes said compressor mechanism comprising a main bearing attached to said motor enclosure, a cylinder block disposed between an end plate and said main bearing and having a roller therein, said roller in contact with a first end of a spring biased vane reciprocally supported in a slot provided in said block.

12. The rotary compressor of claim 11, wherein said vane is vertically oriented and a lower portion of an inner surface of said housing defines a sump including a quantity of oil therein, a portion of said vane disposed in said quantity of oil.

13. The rotary compressor of claim 12, wherein said shaft is positioned substantially horizontally.

14. A rotary compressor, which draws a suction gas and discharges a compressed discharge gas, said compressor comprising:

a housing;

a compressor subassembly disposed in said housing and comprising a motor drivingly coupled to a compressor mechanism by means of a shaft;

a motor enclosure connected to said compressor mechanism and encasing said motor; and a quantity of oil disposed in a lower portion of said housing, said compressor subassembly being in fluid communication with said quantity of oil through said motor enclosure;

wherein at least a portion of the compressed discharge gas from said compressor subassembly is directed through said quantity of oil to form a sound damping foam.

15. The rotary compressor of claim 14, wherein said quantity of oil has a surface level, said motor enclosure includes an aperture therein and said aperture is positioned substantially below said surface level of said oil.

16. The rotary compressor of claim 14, wherein substantially all the compressed discharge gas is directed through said quantity of oil.

17. The rotary compressor of claim 14, wherein said motor includes a stator disposed in said motor enclosure, a channel is formed between said stator and said motor enclosure, said channel is positioned adjacent an aperture in said motor enclosure and below said surface level of said oil, oil in said motor enclosure being substantially purged from said motor enclosure by the compressed discharge gas flow through said channel.

18. The rotary compressor of claim 14, wherein said shaft is positioned substantially horizontally.

19. A rotary compressor which draws a suction gas and discharges a discharge gas, said compressor comprising:

a housing;

a compressor subassembly disposed in said housing and comprising a main bearing, a motor drivingly coupled to a compressor mechanism by means of a shaft and a motor enclosure connected to said compressor mechanism and encasing said motor;

a first discharge chamber defined by said main bearing and an inner surface of said motor enclosure, said main bearing attached to said motor enclosure; and a second discharge chamber defined by an inner surface of said housing and an outer surface of said compressor subassembly, said first and second discharge chambers in fluid communication through an aperture provided in said motor enclosure, said first and second discharge chambers constitute a pair of mufflers which consecutively receive the discharge gas.

20. The rotary compressor of claim 19, further comprising a quantity of oil disposed in said second discharge chamber, said aperture in said motor enclosure submerged in said quantity of oil, wherein the discharge gas urged through said quantity of oil forms a sound damping foam, said sound damping foam constituting a fluid muffler.

21. The rotary compressor of claim 19, wherein said sound damping foam provides said fluid muffler intermediate said first and second mufflers formed by respective said first and second discharge chambers.

22. The rotary compressor of claim 19, wherein said shaft is positioned substantially horizontal.

23. A method of assembling a rotary compressor comprising the steps of:

providing a motor enclosure including a first axial end which is open and a second axial end having a projecting portion which includes a hole extending through the projecting portion;

attaching a stator within the motor enclosure;

attaching a rotor to a motor shaft to form a rotor assembly and inserting a first end of the shaft into a main bearing;

assembling the rotor assembly and main bearing with the motor enclosure such that the main bearing fits within the open end of the motor enclosure and a second end of the motor shaft extends within an interior of the projecting portion;

inserting a mounting tool into the hole of the projecting portion to pilotingly engage the second end of the motor shaft;

aligning the rotor assembly with the stator by selectively positioning the mounting tool to establish a substantially uniform radial rotor-stator air gap positioned between the stator and rotor;

joining the main bearing to the motor enclosure;

removing the mounting tool from the hole in the projecting portion of the motor enclosure;

attaching a compressor mechanism to an outer lateral surface of the main bearing which engages with and is driven by the first end of the motor shaft to form a compressor subassembly;

attaching a post to the compressor mechanism which extends axially opposite of the projecting portion of the motor enclosure; and mounting the projecting portion and post of the compressor subassembly into respective resilient mounts within an interior of a housing and hermetically sealing the housing.

24. The method of assembling a rotary compressor of claim 23, further comprising the step of inserting a spring between an interior of the housing and a vane within the compressor mechanism whereby the vane is urged against a roller.

* * * * *

UNITED STATES PATENT AND TRADEMARK OFFICE

CERTIFICATE OF CORRECTION

PATENT NO. : 6,361,293 B1
DATED : March 26, 2002
INVENTOR(S) : Harold M. Harper et al.

It is certified that error appears in the above-identified patent and that said Letters Patent is hereby corrected as shown below:

Title page,
Item [54], please change the title to read -- HORIZONTAL ROTARY COMPRESSOR AND METHOD OF ASSEMBLING SAME --

Signed and Sealed this

Eighth Day of October, 2002

*Attest:*

*Attesting Officer*

JAMES E. ROGAN
*Director of the United States Patent and Trademark Office*